US012372234B2

(12) United States Patent
Elsässer et al.

(10) Patent No.: US 12,372,234 B2
(45) Date of Patent: Jul. 29, 2025

(54) REGENERATIVE POST-COMBUSTION DEVICE, COATING INSTALLATION, AND METHOD FOR COATING OBJECTS

(71) Applicant: EISENMANN ENVIRONMENTAL TECHNOLOGY GMBH, Böblingen (DE)

(72) Inventors: Marcel Elsässer, Unterjettingen (DE); Gerd Krohne, Altdorf (DE); Gerda Rommel, Herrenberg (DE)

(73) Assignee: Eisenmann Environmental Technology GMBH, Böblingen (DE)

( * ) Notice: Subject to any disclaimer, the term of this patent is extended or adjusted under 35 U.S.C. 154(b) by 561 days.

(21) Appl. No.: 17/434,859

(22) PCT Filed: Feb. 27, 2020

(86) PCT No.: PCT/EP2020/055168

§ 371 (c)(1),
(2) Date: Aug. 30, 2021

(87) PCT Pub. No.: WO2020/178140

PCT Pub. Date: Sep. 10, 2020

(65) Prior Publication Data

US 2022/0163201 A1 May 26, 2022

(30) Foreign Application Priority Data

Mar. 1, 2019 (DE) ..... 10 2019 105 283.1

(51) Int. Cl.
*F23G 7/06* (2006.01)
*F28D 17/02* (2006.01)

(52) U.S. Cl.
CPC ..... *F23G 7/068* (2013.01); *F28D 17/02* (2013.01); *F23G 2202/106* (2013.01); *F23G 2206/10* (2013.01); *F23G 2209/14* (2013.01)

(58) Field of Classification Search
CPC ..... F23G 7/068; F23G 2202/106; F23G 2206/10; F23G 2209/14; F28D 17/02
(Continued)

(56) References Cited

U.S. PATENT DOCUMENTS 3,895,918 A * 7/1975 Mueller ..... F23G 7/07 110/212
4,426,360 A * 1/1984 Benedick ..... F23G 7/068 110/190

(Continued)

FOREIGN PATENT DOCUMENTS

CA 2 161 860 1/2000
CA 2 353 398 4/2001

(Continued)

OTHER PUBLICATIONS

KR 1714027 B1—Translation (Year: 2017).*

(Continued)

*Primary Examiner* — Steven B McAllister
*Assistant Examiner* — Benjamin W Johnson
(74) *Attorney, Agent, or Firm* — Schroeder Intellectual Property Law Group, LLC

(57) ABSTRACT

A regenerative post-combustion device which has, along a longitudinal axis, a combustion chamber, a heat exchanger space, which is divided into at least two heat exchanger segments each filled with heat exchanger material, a distribution space which, corresponding to the heat exchanger space, having at least two distribution segments which each communicate with a heat exchanger segment, and a distribution device having at least one exhaust gas passage opening and at least one clean gas passage opening, wherein the exhaust gas passage opening is arranged angularly offset to the clean gas passage opening such that the exhaust gas passage opening communicates with a first distribution (Continued)

segment and the clean gas passage opening communicates with a second distribution segment different from the first distribution segment, and the exhaust gas passage opening and the clean gas passage opening are located at different radial distances from the vertical axis of the post-combustion device. The distribution space has a shut-off device and a bypass line for at least one distribution space segment, the shut-off device being configured such that a partial volume flow can be diverted from the associated heat exchanger segment via the bypass line instead of through the exhaust gas passage opening or/and the clean gas passage opening.

13 Claims, 3 Drawing Sheets

(58) Field of Classification Search
USPC ..... 432/180
See application file for complete search history.

(56) References Cited

U.S. PATENT DOCUMENTS

| | | | | |
|---|---|---|---|---|
| 4,802,423 | A * | 2/1989 | Pennington | F23G 5/008 110/211 |
| 5,016,547 | A | 5/1991 | Thomason | |
| 5,562,442 | A | 10/1996 | Wilhelm | |
| 5,941,073 | A | 8/1999 | Schedler et al. | |
| 6,612,833 | B1 | 9/2003 | Poetzl | |
| 2011/0023314 | A1 * | 2/2011 | Schwerer | F26B 23/022 34/86 |

FOREIGN PATENT DOCUMENTS

| | | | | |
|---|---|---|---|---|
| CN | 103 968 393 | A | 8/2014 | |
| CN | 104 081 126 | A | 10/2014 | |
| CN | 105 588 133 | A | 5/2016 | |
| CN | 206 514 318 | | 9/2017 | |
| DE | 197 16 877 | | 12/1998 | |
| DE | 199 10 687 | | 10/2000 | |
| DE | 199 48 212 | | 11/2000 | |
| DE | 19948212 | C1 * | 11/2000 | F23G 7/068 |
| DE | 199 50 891 | | 4/2001 | |
| EP | 0 548 630 | | 6/1993 | |
| EP | 0 719 984 | | 7/1996 | |
| KR | 1714027 | B1 * | 3/2017 | F23G 5/442 |
| WO | 2010/004010 | | 1/2010 | |

OTHER PUBLICATIONS

DE 19948212 C1—Translation (Year: 2000).*
Office Action in related CN App. No. 2020800180169 dated Jun. 14, 2023, 16 pages.

* cited by examiner

REGENERATIVE POST-COMBUSTION DEVICE, COATING INSTALLATION, AND METHOD FOR COATING OBJECTS

RELATED APPLICATIONS

This application is a § 371 national phase of International Patent Application No. PCT/EP2020/055168 filed Feb. 27, 2020, which claims the filing benefit of German Patent Application No. 10 2019 105 283.1 filed Mar. 1, 2019, the contents of both of which are incorporated herein by reference.

BACKGROUND OF THE INVENTION

1. Field of the Invention

The invention relates to a post-combustion device, a coating installation comprising such a post-combustion device, and a method for coating objects using such a coating installation.

2. Description of the Prior Art

Regenerative post-combustion devices are known which have a heat exchanger space which is divided into segments and whose heat exchanger segments are passed through from top to bottom or from bottom to top with alternating flow direction. The aim here is, on the one hand, to achieve purification of an exhaust gas stream laden with hydrocarbon compounds, for example from a coating plant, by heating the exhaust gas stream. On the other hand, the energy input required for such heating is to be kept as low as possible. For this purpose, the thermal energy used for heating the exhaust gas to be cleaned can be at least partially extracted from the clean gas by means of said segmentally divided heat exchanger and returned to the laden exhaust gas.

For this purpose, the above-mentioned build type may, for example, have a so-called rotary distributor which, depending on a rotary position, applies exhaust gas to certain heat exchanger segments and, after the cleaning process, releases an outflow of the clean gas via other heat exchanger segments. By continuously or gradually changing the rotational position, a heat exchanger segment can thus successively absorb the waste heat of the clean gas during certain periods and release it again to the exhaust gas for preheating during subsequent periods.

In the case of certain exhaust gas compositions, the chemical compounds contained in the exhaust gas may react in an undesirable manner or assume aggregate states at certain temperatures, which may lead to a precipitate in the heat exchanger. These precipitates can adhere to heat exchanger walls in an undesirable manner as solids, making heat transfer more difficult and thus reducing efficiency. Alternatively, or in addition, the precipitates may be in a liquid phase within the heat exchanger and accumulate in undesirable locations within the post-combustion device.

SUMMARY OF THE INVENTION

It is an object of the present invention to provide a regenerative post-combustion device in which the aforementioned problem of an undesired precipitate in the post-combustion device can be countered.

This object is solved by a post-combustion device according to independent claim 1. Further embodiments of the invention are provided in the dependent claims.

The post-combustion device according to the invention comprises the following along a longitudinal axis, for example from top to bottom: A combustion chamber, a heat exchanger space, a distribution space and a distribution device.

The combustion chamber serves to further supply the exhaust gas stream, which has already been heated by the heat exchanger in the heat exchanger space, with such a quantity of thermal energy that the desired cleaning can take place. For this purpose, a burner may be used in the combustion chamber, for example.

Below the combustion chamber a heat exchanger space is arranged, which is divided into at least two heat exchanger segments, each filled with heat exchanger material. A typical number of heat exchanger segments is, for example, 8 or 11, but a smaller number of segments or a larger number are also possible. The heat exchanger material may be, for example, a ceramic. The heat exchanger material may be in bulk form or in solid single-part or multi-part form.

In an exemplary embodiment, the heat exchanger segments may be formed as circular segments.

The distribution space is arranged below the heat exchanger space and has a number of distribution segments corresponding to the number of heat exchanger segments, each of which is in fluidic connection with the heat exchanger segments.

The distribution device located below the distribution space has at least one exhaust gas passage opening and at least one clean gas passage opening. Via the exhaust gas passage opening, exhaust gas to be cleaned, for example from a coating system, can flow into one or more segments of the distribution space and from there into the corresponding heat exchanger segment or segments. Clean gas can flow from one or more heat exchanger segments into the respective distribution space segment(s) and from there through the clean gas passage opening.

The exhaust gas passage opening and clean gas passage opening are arranged angularly offset from one another such that the exhaust gas passage opening communicates with a first distribution segment and the clean gas passage opening communicates with a second distribution segment different from the first distribution segment, and the exhaust gas passage opening and the clean gas passage opening are located at different radial distances from the vertical axis of the post-combustion device.

In this way, for example, by means of a relative movement between the passage opening and the distribution space or by means of a closing and opening of different passage openings, different heat exchanger segments may be indirectly flowed through in different directions.

According to the invention, the distribution space has a shut-off device and a bypass line for at least one distribution space segment. The shut-off device is configured such that a partial volume flow can be guided via the bypass line and then again through the associated heat exchanger segment instead of through the exhaust gas passage opening or/and the clean gas passage opening. It is therefore possible in this way to circulate a heated gas flow within one or more heat exchanger segments and thus to ensure a significantly higher temperature in this/these heat exchanger segment(s).

In a further development of the invention, it can be provided that the shut-off device comprises a bypass valve, wherein the bypass valve is configured such that, in a first state of the bypass valve, a throughflow is impeded or prevented and, in a second state of the bypass valve, a largely free throughflow is possible. Thus, the opening or partial/full closing of the passage openings may be supported by a partial/full closing or opening of the bypass valve.

Advantageously, the bypass line connects the bypass valve of a distribution segment to the combustion chamber. If the shut-off device is in a state in which it completely or partially closes the exhaust gas or clean gas passage opening and if the bypass valve is in a state in which it completely or partially releases the bypass line, the exhaust gas or clean gas can flow through the heat exchanger segment via the bypass line and be heated up again in the combustion chamber. This repeated heat input leads to a temperature increase in the concerned heat exchanger segment and can thus lead to a chemical or/and physical conversion of any deposits adhering to the inside of the heat exchanger segment and thus ultimately to easier removal of such deposits.

Alternatively or additionally, the bypass line may be connected to an additional heating device in order to achieve the required temperature rise. This has the advantage that the heat input can be adjusted more specifically to the respective heat exchanger segment.

In a further development of the post-combustion device, a bypass ring line is provided, which is connected to a plurality of bypass lines. Bundling the bypass lines and returning them together, for example to the combustion chamber or to an additional heating device, enables more efficient line routing and more uniform introduction of the recirculated exhaust gas/clean gas.

In one embodiment, the post-combustion device comprises a blower device or/and a heat-generating device, wherein the bypass line is connected to the blower device or/and the heat-generating device. The blower device enables targeted control of the recirculated or circulated volume flow through the bypass line and thus also through the heat exchanger segment or segments concerned.

In one embodiment of the post-combustion device, a motorized and/or pneumatic drive can be provided for the shut-off device for shutting off and/or partially or completely opening the passage openings. Advantageously, the shut-off device is located on the side of the heat exchanger space facing away from the combustion chamber, so that the shut-off device is not subjected to the high temperatures of the combustion chamber and can thus easily be provided with a motorized or pneumatic drive and thus be controlled in a simple manner.

In this context, it can be advantageously provided that the actuator is provided for a plurality of shut-off devices.

Specifically, the distribution device can be configured as a rotary slide valve. Such a device is described in detail in the disclosure document DE 199 50 891 A1. Reference is hereby made to the aforementioned disclosure with regard to the relevant structure of a post-combustion device and the configuration of a rotary slide valve.

In one specific embodiment of the shut-off device, this may comprise a flap or a flat slide valve. The flap may be configured as a rotary or swivel flap.

The object is further solved by a coating installation including a post-combustion device as described above, as well as by a method for coating objects such as vehicle bodies or vehicle components with such a coating installation.

Overall, by means of the invention, a partial volume flow may be at least partially returned to the combustion chamber via a bypass and an exhaust duct. For this purpose, a bypass which can be shut off can be provided in the flow path at the outlet of one or more heat exchanger segments upstream of the inlet to a rotary valve in a regenerative post-combustion device. Closing the transition from the heat exchanger into the rotary valve and opening the bypass have the effect that the shut-off heat exchanger segment is separated from the actual heat exchange process and can be flowed through via the partial volume flow from top to bottom or from bottom to top. Via this partial volume flow, heat can be supplied from outside, for example, or heat is additionally conducted through the heat exchanger segment from the combustion chamber of the post-combustion device in order to carry out a so-called bake-out, burnout or pyrolysis.

Several bypass lines, that can be shut off, can be routed to a common line, for example as a ring line. This ring line is connected to the combustion chamber or alternatively/additionally to a hot gas generation unit.

It is also possible to return one or more bypass routes directly to the combustion chamber. Each bypass route may be equipped with a blower unit. Several bypass routes can be served by a common blower unit.

A bypass route may be varied in flow cross-section or closed by a valve unit.

A motorized/pneumatic drive can act on one or more valve units.

The shut-off unit, which can close the transition from the heat exchanger to the rotary valve, may be configured as a flap or a flat vane. Rotary or swivel flaps are possible. The flaps may be manually operated or have a motorized drive. An electric or pneumatic drive may act on one or more shut-off units.

BRIEF DESCRIPTION OF THE DRAWINGS

In the following, embodiments of the invention are explained in more detail with reference to the drawings.

DESCRIPTION OF PREFERRED EMBODIMENTS

Figure 2:
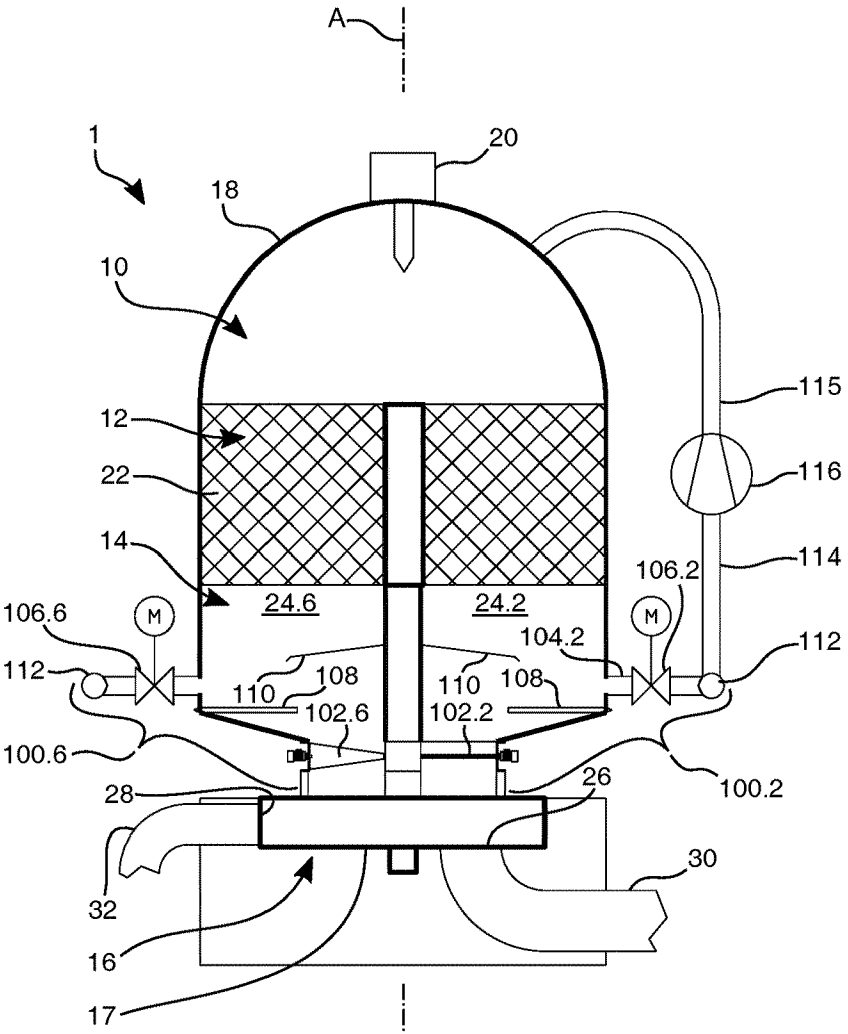
FIG. 2 shows a view of the embodiment of FIG. 1 with the shut-off device in a second state.
Figure 1:
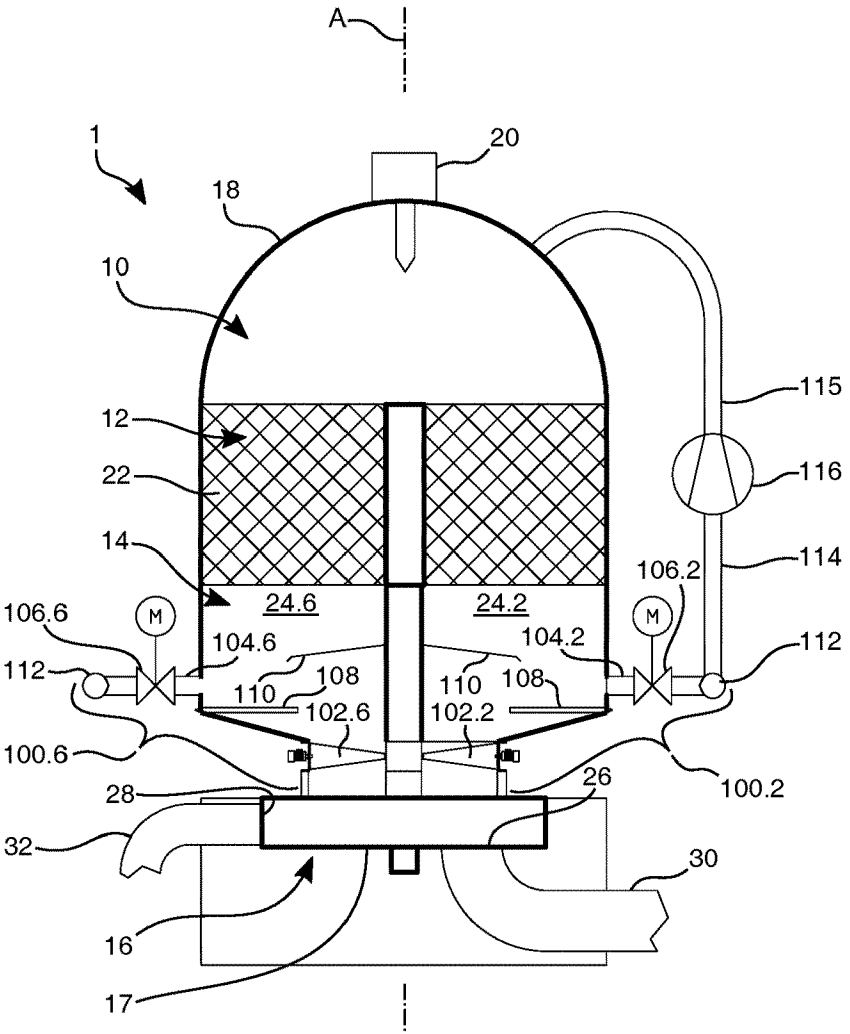
FIG. 1 shows a longitudinal sectional view of an embodiment of a post-combustion device with a shut-off device in a first state.

FIGS. 1 and 2 show cross-sectional views of a regenerative post-combustion device 1. The basic construction as well as the basic mode of operation are—unless otherwise stated below—described in EP 0 548 630 1 or EP 0 719 984, to which reference is explicitly made. The basic construction and the basic mode of operation of a rotary distributor, as will be described below as a component of the combustion device, are—unless otherwise stated below—described in DE 199 50 891, to which reference is explicitly made.

The regenerative post-combustion device 1 of FIG. 1 is basically rotationally symmetrical about a longitudinal axis A. The longitudinal axis A usually extends vertically, so that the post-combustion device 1 has the following from top to bottom: a combustion chamber 10, a heat exchanger space 12, a distribution space 14 and a distribution device 16.

In the embodiment shown in FIG. 1, the aforementioned components are received in a common housing 18. Of course, the housing 18 may also be composed of several parts.

The combustion chamber 10 has a dome-like basic structure and a burner 20 which can heat the gas volume located in the combustion chamber 10. Depending on the embodiment, temperatures between 750° C. and 800° C. or higher may be achieved, for example.

In the present case, the heat exchanger space 12 is divided into eight heat exchanger segments 22, two of which are visible in the longitudinal sectional view of FIG. 1. The heat exchanger segments 22 are filled with a heat exchanger material through which exhaust gas or clean gas can flow.

Figure 4:
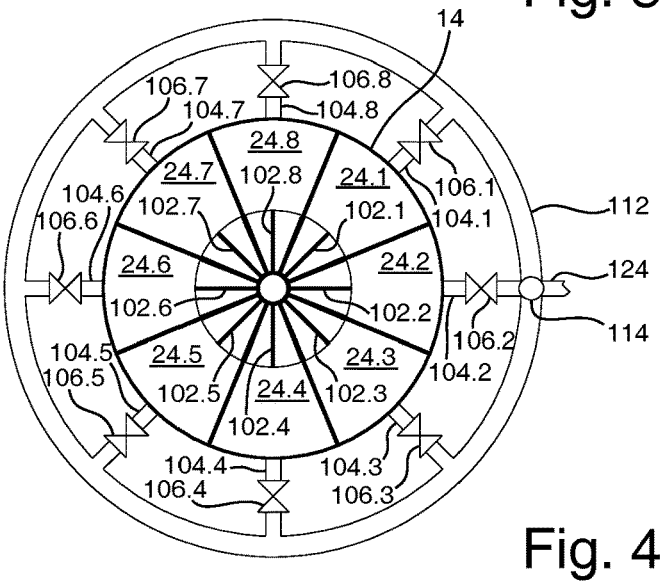
FIG. 4 shows a cross-sectional view along plane IV-IV of FIG. 3.
Figure 7:
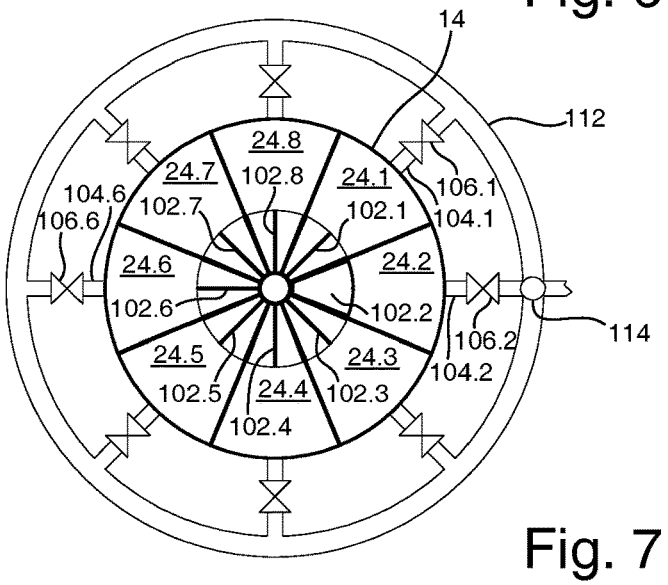

The distribution space 14 arranged below the heat exchanger space 12 is also provided with the same division into individual distribution segments 24, of which two distribution segments 24.6, 24.2 are shown in FIG. 2. FIGS. 4 and 7 show the arrangement of the distribution segments 28.1-28.8 in sectional views perpendicular to the longitudinal axis 4 of another embodiment. The distribution segments 24 thus correspond in number and fluidic configuration to the heat exchanger segments 22 of the heat exchanger space 12.

In the embodiment shown in FIG. 1, the distribution device 16 below the distribution space 14 is configured as a rotary distributor 17, as explained in detail, for example, in the aforementioned and referenced DE 199 50 891. The distributor device 16 thus has an exhaust gas passage opening 26 for an exhaust gas supply line 30 and a clean gas passage opening 28 for a clean gas discharge line 32. In the illustration shown in FIG. 1, the openings 26, 28 are only schematically indicated. In a specific embodiment, the passage openings 26, 28 may, for example, be arranged at different radial distances from the vertical axis A. In this way, a connection to the exhaust gas supply line 30 or the clean gas discharge line 32 may be implemented for each heat exchanger segment 22 or distribution segment 24 via corresponding annularly arranged flow spaces within the distribution device. An opening or closing of the passage openings 26, 28, which are arranged angularly offset relative to one another such that the exhaust gas passage opening 26 communicates with a first distribution segment 24 and the clean gas passage opening 28 communicates with a second distribution segment 24 different from the first distribution segment 24, opens up, starting from the exhaust gas supply line 30, different flow paths through one or more distribution segments 24 or heat exchanger segments 22 into the combustion chamber 10 and vice versa from the combustion chamber 10 to the clean gas discharge line 32.

In the embodiment shown in FIG. 1, the distribution space 14 is provided with several shut-off devices 100 in its lower region, i.e., facing away from the combustion chamber 10. The shut-off devices 100 each comprise a shut-off flap 102 and a bypass line 104, two of which are shown in each of FIGS. 1 and 2. FIGS. 4 and 7 of the alternative embodiment show the arrangement of the shut-off devices 100.1-100.8 and the shut-off flaps 102.1-102.8 and the bypass lines 104.1-104.8, respectively, in a cross-sectional view.

The shut-off flaps 102 are arranged in the distribution space 14 such that, in a closed position of a shut-off flap 102, an overflow from the respective distribution segment 24 into the distribution device 16 and thus, in particular, into the clean gas discharge line or, conversely, from the exhaust gas supply line via the distribution device 16 into the distribution space 14 or the heat exchanger space 12 is prevented. In contrast, in an open position of a shut-off flap 102, overflow from the exhaust gas supply line 30 into the heat exchanger 12 or from the heat exchanger 12 into the clean gas discharge line 32 is possible. In general, the shut-off flaps 102 may be configured to be movable only to an open position or a closed position. Alternatively, it is also possible to configure the shut-off flaps 102 such that intermediate positions may also be adopted. This enables control of a partial volume flow that can be directed via the bypass line 104.

The individual bypass lines 104 are provided at each of the distribution segments 24 and are interconnected by a common ring line 112. Furthermore, the ring line 112 is connected to the combustion chamber 10 by a line 114, a blower 116 and a line 115. In the ring line 112 or in individual bypass lines 104, a pressure gradient can be generated, for example, by the blower 116 in the direction of the combustion chamber 10.

In the embodiment shown in FIG. 1, the two shut-off flaps 102 shown are each in an open position.

In the embodiment shown in FIG. 1, the bypass lines 104 are each provided with a bypass valve 106. The bypass valve 106 allows the bypass line 104 to be blocked when the shut-off flaps 102 are in an open position, and releases the respective bypass line 104 if the shut-off flap 102 is fully or partially closed and flow into the clean gas discharge line 32 or inflow via the exhaust gas supply line 30 is prevented.

In addition to the shut-off device 100, the distribution space 14 has collecting plates 108 and dripping plates 110. The aforementioned structures 108, 110 prevent fouling of the shut-off device 100 by condensing or dripping material from the heat exchanger space 12. At the same time, the material collected in the collecting plates can be converted into less problematic substances under certain operating conditions, which will be explained in more detail later. In one embodiment, the collection plates may also be configured to be heatable.

Temperature sensors may be provided at the lower end of the heat exchanger segment 22 as well as, for example, in the bypass line 104, which may be used for process control, for example, opening and/or closing the shut-off flaps 102 or/and the bypass valves 106.

FIG. 2 shows the same embodiment of a post-combustion device 1 as in FIG. 1, in which one of the two shut-off flaps 102 (102.2) shown is in a closed position.

The operation of the post-combustion device 1 is as follows: Exhaust gas loaded with hydrocarbon compounds, for example, from a coating plant (not shown) is fed in via the exhaust gas supply line 30. Depending on the position of the exhaust gas passage openings 26, this exhaust gas is introduced into certain distribution segments 24 of the distribution space 12 and passes from there into the associated heat exchanger segments 22. The exhaust gas thereby absorbs the thermal energy stored in the heat exchanger segments 22 in order to subsequently, after flowing into the combustion chamber 10, be increased there even further to the required temperature level by means of the burner 20. Depending on the position of the distribution device 16, i.e. the rotary distributor 17 in the embodiment shown in FIG. 1, the clean gas thus purified flows in turn via other heat exchanger segments 22 and associated distribution segments 24 via the clean gas passage opening 28 into the clean gas outlet 32. The clean gas thereby gives off some of its thermal energy to the material in the heat exchanger segments 22. Thus, a temperature gradient is formed within a heat exchanger segment 22 from top to bottom, i.e., from the combustion chamber 10, to the distribution space 14. This temperature gradient can range, for example, from 800° C. in the combustion chamber to 200° C. in the distribution space 14. Any liquid condensate or other liquid or solid components that occur accumulate/deposit in the heat exchanger segments 22 and can be partially collected via the drip plates 110 in the collection plates 108.

By changing the position of the rotary distributor 17, the flow direction of certain heat exchanger segments 22 changes cyclically after certain periods of time—for example 10 s—via a "moving on" of the passage openings 26, 28.

As soon as the solid or liquid condensate occurring, for example tar or ammonium compounds, exceeds a certain quantity or a certain operating time is reached, the shut-off device 100.2 can be actuated, as shown in FIG. 2, and the shut-off valve 102.2 can be closed and the bypass line 104.2 released via the bypass valve 106.2. At the same time, the blower 116 can generate the required pressure drop.

In this way, circulation of the gas located in the corresponding heat exchanger segment 22 occurs. As a result of the continuous circulation over the combustion chamber 10, the temperature level in the corresponding heat exchanger segment 22 is gradually raised, for example to 500° C. on the outlet side (distribution space side), and chemical or physical processes can be initiated or can occur in a desired manner within the concerned heat exchanger segment 22, which lead to a reduction or complete degradation of the deposits within the heat exchanger segment 22, in the distribution segment 22 located therebelow, and/or in the collection plates 108 or the drip plates 110. In this regard, it is preferred that only one or a few heat exchanger segments 22 be removed from normal operation and cleaned.

Figure 3:
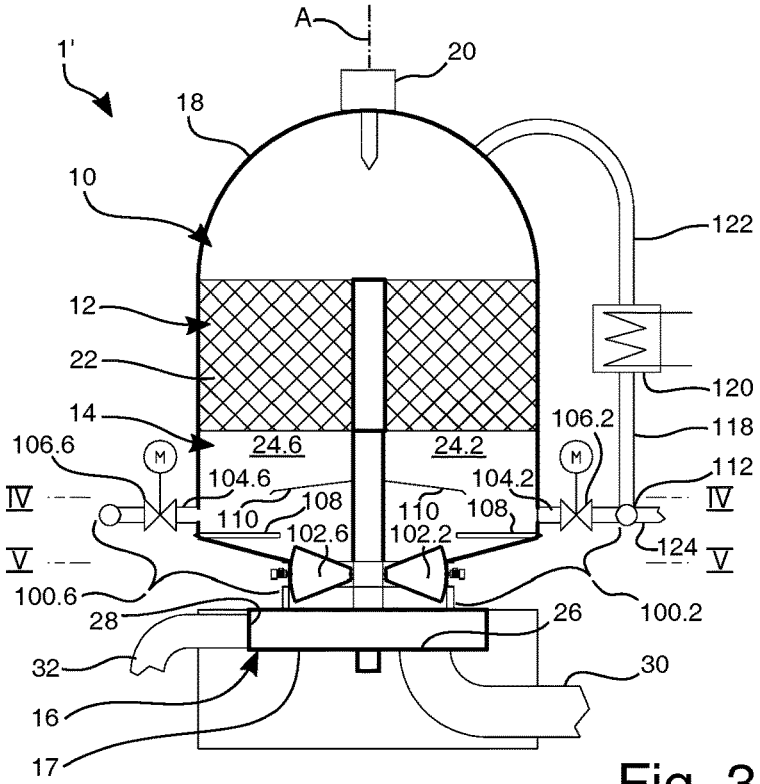
FIG. 3 shows a longitudinal sectional view of an alternative embodiment of a post-combustion device with the shut-off device being accentuated.
Figure 6:
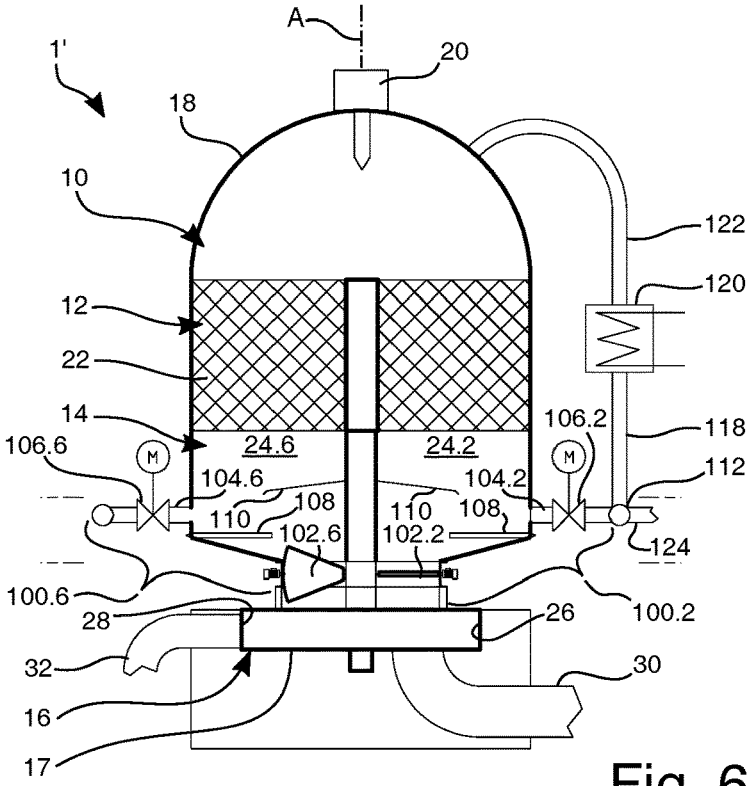
FIGS. 6-8 show the views of FIGS. 3-5 with the shut-off device in the second state.

FIGS. 3 and 6 illustrate in a longitudinal sectional view a post-combustion device 1' in a slightly modified embodiment compared to the embodiment in FIG. 1. Identical or comparable features are designated by the same reference sign and are not explained again separately.

In contrast to the embodiment of FIGS. 1 and 2, in the embodiment of FIGS. 3 and 6 the ring line 112 is connected via a line 118 to a temperature control device 120, which in turn is connected via a line 122 to the combustion chamber 10. The temperature control device 120 can cause a temperature reduction of the gas present in the heat exchanger segment 22 as well as the distribution segment 24 independently of the combustion chamber 10, for example to reduce the heat load for a subsequent blower. If necessary, the temperature control device 120 may also alternatively provide an additional heat input.

When the shut-off valve 103 is closed and the bypass valve 106 is opened, the gas located in the heat exchanger segment 22 can flow via the bypass line 104 to the temperature control device 120 via the line 118, be tempered there and in turn be supplied to the upper side of the heat exchanger segment 22 via the line 122. In this way, overheating of the heat exchanger material located in the heat exchanger segment 22, of the inner wall of the distribution segment 24 and, if applicable, of the drip plates 110 and collection plates 108 can be achieved, for example, while at the same time protecting a fan by lowering the temperature.

As can be seen from FIGS. 3 and 4, in the embodiment shown in these figures, the ring line 112 is provided with a branch 124. The branch 124 can serve, for example, to feed the waste gases produced during such a pyrolysis, as well as any solid/liquid reaction materials therein that may not be able to be discharged as clean gas via the line 32, to a controlled disposal. This can occur, for example, at certain operating conditions/temperature levels.

Figure 5:
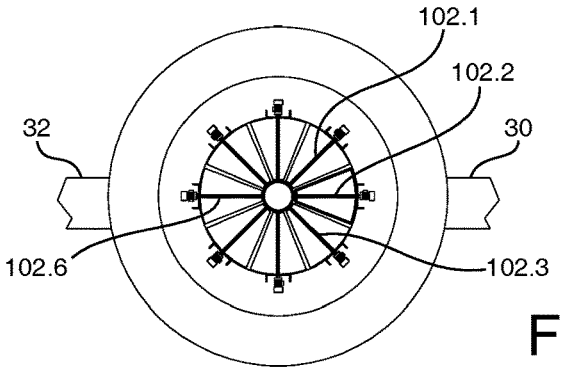
FIG. 5 shows a cross-sectional view along plane V-V of FIG. 3.
Figure 8:
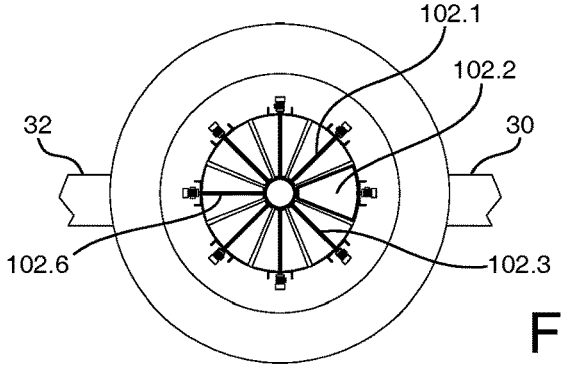

To further illustrate the invention, FIGS. 4 and 7 each show sectional views along a plane IV-IV (marked in FIGS. 3 and 6, respectively) that runs perpendicular to longitudinal axis A through bypass lines 104.1-104.8. In FIGS. 5 and 8, sectional views are shown along a plane V-V, which is also perpendicular to the longitudinal axis A through the shut-off flaps 102.1-102.8.

FIGS. 4 and 7 show sectional views of the ring line 112 and associated bypass lines 104.1-104.8 and bypass valves 106.1-106.8. The arrangement and shaping of the ring line 112 as well as the bypass lines 104 is only schematic. In reality, the ring line 112 may be integrated into a housing wall of the housing 18, for example.

As can be seen from FIGS. 3-8, in the embodiment shown, it is intended to close the exhaust gas passage opening 26 or the clean gas passage opening 28 by means of the associated shut-off flaps 102.1-102.8.

FIGS. 5 and 8 illustrate the arrangement of the shut-off flaps 102.1-102.8. While in FIG. 5 all shut-off flaps 102.1-102.8 are open, in FIG. 8 a position is shown in which shut-off flap 102.2 is closed but the other shut-off flaps 102.1, 102.3-102.8 are open. This can also be seen accordingly in FIGS. 4 and 7.

With the shut-off flaps 102.1-102.8 in the position shown in FIG. 4, flow is possible through each heat exchanger segment 22 via the distribution segments 24.1-24.8. The passage openings 26, 28 determine the direction of flow through each heat exchanger segment 22. For example, the heat exchanger segments 22 which are supplied by the distribution segments 24.1-24.4 can be connected to the exhaust gas supply line 30 at their underside with the exhaust gas passage opening 26. At the same time, the heat exchanger segments 22, which are supplied by the distribution segments 24.5-24.8, can be connected at their underside with the clean gas passage opening 28 to the clean gas discharge line 32. Accordingly, for the distribution segments 24.1-24.4 and the associated heat exchanger segments 22, there is a flow from bottom to top from the distribution space 14 in the direction of the combustion chamber 10, and for the distribution segments 24.5-24.8, there is a flow from top to bottom from the combustion chamber 10 in the direction of the distribution space 14.

When the distribution device 16 is switched further, the flow direction of some heat exchanger segments 22 changes accordingly. If one of the heat exchanger segments 22 is connected to the bypass line 104.2 via a shut-off valve, in FIGS. 6-8 the shut-off valve 102.2 and thus the distribution segment 24.2, the gas flow circulates in this heat exchanger segment 22.

This remains the case even if the valve device 16 is switched further, so that significantly higher temperatures (for example 450° C.-500° C.) can form in otherwise cooler areas of a heat exchanger segment 22 over several switching cycles and the desired chemical/or physical processes can occur.

What is claimed is:

1. A regenerative post-combustion device comprising along a longitudinal axis:

a) a combustion chamber;

b) a heat exchanger space, which is divided into at least two heat exchanger segments each filled with heat exchanger material;

c) a distribution space which, corresponding to the heat exchanger space, has at least two distribution segments which each communicate with a heat exchanger segment from the at least two heat exchanger segments;

d) a distribution device having at least one exhaust gas passage opening and at least one clean gas passage opening, wherein the at least one exhaust gas passage opening is arranged angularly offset to the at least one clean gas passage opening such that the at least one exhaust gas passage opening communicates with a first distribution segment from the at least two distribution segments and the at least one clean gas passage opening communicates with a second distribution segment from the at least two distribution segments, the second distribution segment being different from the first distribution segment, and the at least one exhaust gas passage opening and the at least one clean gas passage opening are located at different radial distances from the longitudinal axis of the post-combustion device; and e) a common ring line, wherein f) each distribution segment is fluidically connected to the common ring line via an associated shut-off device and an associated bypass line which begins at the common ring line and ends at the distribution segment for at least partially closing the distribution segment, wherein each shut-off device is configured such that at least a partial volume flow can be diverted via the bypass line from the heat exchanger segment in communication with the distribution space segment instead of through the at least one exhaust gas passage opening and/or the at least one clean gas passage opening, and each bypass line is interconnected via the common ring line and extends between the common ring line and an associated distribution segment.

2. The post-combustion device according to claim 1, wherein each associated shut-off device includes a bypass valve, wherein each bypass valve is configured such that, in a first state of the bypass valve, a throughflow is impeded or prevented in the distribution space segment and, in a second state of the bypass valve, a substantially free throughflow in the distribution space segment is possible.

3. The post-combustion device according to claim 2, wherein each bypass line connects the bypass valve from the each distribution space segment to the combustion chamber.

4. The post-combustion device according to claim 1, further comprising a blower device or/and a heat generating device, wherein each associated bypass line is connected to the blower device or/and the heat generating device.

5. The post-combustion device according to claim 1, wherein the shut-off device comprises a motorized drive.

6. The post-combustion device according to claim 5, wherein the drive drives each associated shut off device.

7. The post-combustion device according to claim 1, wherein the distribution device is configured as a rotary distributor.

8. The post-combustion device according to claim 1, wherein each associated shut-off device comprises a flap.

9. The post-combustion device according to claim 1, wherein each associated shut-off device is manually operable.

10. The post-combustion device according to claim 1, wherein each associated shut-off device comprises a flat slide valve.

11. The post-combustion device according to claim 1, wherein each associated shut-off device further comprises a collecting plate and/or a dripping plate, wherein at least one collecting plate and/or at least one dripping plate is configured within each of the at least two distribution segments and are positioned to shield a respective shut-off device from the heat exchanger space.

12. A coating installation including a regenerative post-combustion device according to claim 1.

13. A method for coating objects such as vehicle bodies with a coating installation according to claim 12.

* * * * *